US008736165B2

(12) United States Patent
Bedynek et al.

(10) Patent No.: US 8,736,165 B2
(45) Date of Patent: May 27, 2014

(54) MERCURY-FREE DISCHARGE LAMP HAVING A TRANSLUCENT DISCHARGE VESSEL

(75) Inventors: Florian Bedynek, Berlin (DE); Matthias Bruchhausen, Berlin (DE); Grigorios Tsilimis, Hamburg (DE); Frank Werner, Berlin (DE)

(73) Assignee: Osram Gesellschaft MIT Beschraenkter Haftung, Munich (DE)

( * ) Notice: Subject to any disclaimer, the term of this patent is extended or adjusted under 35 U.S.C. 154(b) by 177 days.

(21) Appl. No.: 13/129,581

(22) PCT Filed: Sep. 10, 2009

(86) PCT No.: PCT/EP2009/061736
§ 371 (c)(1), (2), (4) Date: Jun. 29, 2011

(87) PCT Pub. No.: WO2010/054872
PCT Pub. Date: May 20, 2010

(65) Prior Publication Data

US 2011/0248628 A1 Oct. 13, 2011

(30) Foreign Application Priority Data

Nov. 17, 2008 (DE) ..... 10 2008 057 703

(51) Int. Cl.
*H01J 61/00* (2006.01)
*H01J 61/12* (2006.01)
*H01J 61/82* (2006.01)

(52) U.S. Cl.
CPC ..... *H01J 61/125* (2013.01); *H01J 61/827* (2013.01)
USPC ..... 313/572; 313/567

(58) Field of Classification Search
CPC ..... H01J 61/125; H01J 61/827
See application file for complete search history.

(56) References Cited

U.S. PATENT DOCUMENTS

| | | | | |
|---|---|---|---|---|
| 5,726,532 | A | 3/1998 | Wittig et al. | |
| 6,353,289 | B1 | 3/2002 | Ishigami et al. | |
| 7,098,596 | B2 | 8/2006 | Takagaki et al. | |
| 7,126,281 | B2 | 10/2006 | Grundmann et al. | |
| 7,705,540 | B2 | 4/2010 | Bedynek et al. | |
| 2004/0051460 | A1 | 3/2004 | Shido et al. | |
| 2004/0150344 | A1 * | 8/2004 | Takagaki et al. | 313/637 |
| 2004/0183446 | A1 * | 9/2004 | Grundmann et al. | 313/637 |

FOREIGN PATENT DOCUMENTS

| | | | |
|---|---|---|---|
| DE | 10334052 | A1 | 3/2004 |
| EP | 0700579 | B1 | 7/1997 |
| EP | 1632985 | A1 | 3/2006 |

OTHER PUBLICATIONS

International Search Report of PCT/EP2009/061736 dated Dec. 15, 2009.

* cited by examiner

*Primary Examiner* — Britt D Hanley

(57) ABSTRACT

A mercury-free discharge lamp with an electrical power consumption of less than 35 Watts may include a translucent discharge vessel which has a discharge space into which electrodes protrude for generating a gas discharge, wherein metal halides and ignition gas are contained in the discharge space, wherein the metal halides are present in a quantity in the range from 5 milligrams to 15 milligrams per 1 milliliter of discharge space volume in the discharge space.

10 Claims, 2 Drawing Sheets

MERCURY-FREE DISCHARGE LAMP HAVING A TRANSLUCENT DISCHARGE VESSEL

RELATED APPLICATIONS

The present application is a national stage entry according to 35 U.S.C. §371 of PCT application No.: PCT/EP2009/061736 filed on Sep. 10, 2009, which claims priority from German application No.: 10 2008 057 703.0 filed on Nov. 17, 2008.

TECHNICAL FIELD

Various embodiments relate to a mercury-free discharge lamp, e.g. a mercury-free halogen metal vapor high-pressure discharge lamp for vehicle headlamps, operated with a power of less than 35 Watts, including a translucent discharge vessel, into the discharge space of which electrodes protrude for generating a gas discharge, metal halides and an ignition gas being present in the discharge space. The value specified hereinabove for the power relates to the quasi-stationary operation of the mercury-free halogen metal vapor high-pressure discharge lamp, i.e. after termination of its ignition and startup phase, when the metal halides in the discharge space of the lamp are fully vaporized. During its startup phase, the lamp can be operated with a significantly higher power.

BACKGROUND

Mercury-free discharge lamps in which the mercury used in a discharge gas is replaced by other metal halides are known from the prior art. However, if no mercury is provided in the closed bulb, the voltage between the electrodes is reduced such that an increased electric current is required for maintaining the voltage. This results in a higher level of power dissipation from the ballast for the mercury-free discharge lamp in comparison to a conventional mercury-containing discharge lamp. Since, where a lamp with a luminous flux of more than 2000 lm, as is emitted by a conventional mercury-free discharge lamp, is installed, it is mandatory additionally to provide a headlamp windshield washing system and a lamp leveling control, the use of mercury-free lamps as standard equipment was not of interest to automotive manufacturers.

In the prior art, for example in US 2004/0150344, it was therefore proposed that a mercury-free discharge lamp with reduced power requirements and decreased luminous flux be achieved by reducing the dimensions of the discharge bulb and shortening the distance between the electrodes in the discharge bulb. In this way, the temperature in the bulb can, despite the reduced power feed, be kept at a level necessary for a constant voltage.

However, a disadvantage of this lamp known from the prior art is that the light arc which forms in the smaller-sized discharge bulb has too low a spatial extension so that use of these lamps in existing headlamps is not possible.

SUMMARY

Various embodiments provide a mercury-free discharge lamp, e.g. a mercury-free halogen metal vapor high-pressure discharge lamp with reduced power, which can be used in conventional headlamps.

Various embodiments provide a discharge lamp with a power of less than 35 Watts, i.e. with an electrical power consumption of less than 35 Watts during its operation after termination of its ignition and startup phase, in which in a translucent discharge vessel, into the discharge space of which electrodes protrude for generating a gas discharge, metal halides and an ignition gas being present in the discharge space. Instead, however, of the usual 10 mg/ml to 30 mg/ml concentration for the metal halides, according to various embodiments metal halides are introduced into the discharge space of the discharge vessel in a fill quantity of only from 5 mg/ml to 15 mg/ml, i.e. 5 milligrams to 15 milligrams of metal halide per 1 milliliter volume of the discharge space.

According to the invention, this reduced fill quantity of metal halide leads to an increase in the arc width such that an adequate dimensioning of the arc can be achieved even in a discharge lamp operated with a power of less than 35 Watts.

A further factor influencing the power requirement and the emitted luminous flux is the thermal characteristics of the lamp. The more heat is dissipated from the discharge vessel or discharge space, the more power is needed to provide a comparable "cold spot" temperature (that is the temperature at the coolest point in the discharge space) and a comparable luminous efficiency.

The discharge space is usually additionally enveloped by an outer bulb which, filled with air, provides some, if not good, thermal insulation of the discharge space. However, changing the gas filling of the outer bulb makes it possible to alter the thermal characteristics of the lamp and to improve the thermal insulation of the discharge space. The influence of the filling of the outer bulb on the temperature of the discharge space is described in DE 103 34 052, for example.

In a further preferred exemplary embodiment, a gas or gas mixture with lower thermal conductivity than air is therefore introduced into an intermediate space defined by outer bulb and discharge vessel. This leads to less heat being removed from the discharge space to the outer bulb so that, at the same power, a higher temperature and thus also a higher "cold spot" temperature and luminous efficiency are achieved. This leads by inference to the fact that, for the same luminous efficiency and temperature, the power at which the discharge lamp is operated can be reduced.

Instead of a gas with reduced conductivity, it is also possible to evacuate the intermediate space between discharge vessel and outer bulb, which likewise makes it possible to achieve an improved thermal insulation of the discharge space.

Particularly preferred as filling gases for the outer bulb are, for example, Xe, $I_2$, $SF_6$ and Ar.

In addition, as a further preferred embodiment shows, instead of a standard pressure of 0.5 bar, the gas can be introduced into the intermediate space at a pressure of 0.05-0.2 bar. Particularly where xenon gas and argon are used, a pressure of from 0.05 bar to 0.2 bar has proven particularly advantageous.

Since, as described hereinabove, the power requirements of the lamp are determined in particular by the temperature to be attained in the discharge space, other parameters influencing the temperature can also be changed. For example, the temperature prevailing in the discharge space is also determined in part by the dimensioning of the discharge vessel itself and of the electrodes arranged therein.

Thus, in a further preferred exemplary embodiment, for example, the dimensions of the discharge space can be reduced, the discharge vessel advantageously having in a central region between the opposing electrodes an internal diameter of from 1.5 mm to 2.7 mm, in particular from 2.1 mm to 2.5 mm. Additionally or alternatively, the volume of the discharge space can also be defined at from 16 $mm^3$ to 34

$mm^3$, in particular from 17 $mm^3$ to 22 $mm^3$, so as to decrease the power requirements of the discharge lamp.

In a further preferred exemplary embodiment, the optical distance between the electrodes arranged opposite one another in the discharge space is reduced to a value of from 3.2 mm to 3.8 mm instead of the usual 4.2 mm. Furthermore, the length of the electrode portion extending in the discharge space can be optimized to a value of from 0.3 mm to 1.8 mm. Additionally or alternatively, the diameter of the electrodes can also be set to a value of between 0.2 mm and 0.3 mm, in particular between 0.23 mm and 0.28 mm, by which means the temperature in the discharge space, and thus the power requirements of the discharge lamp, can likewise be influenced.

Particularly advantageous is a discharge lamp in which the power is reduced not only in normal operation, i.e. during its operation after termination of the ignition and startup phase, but the power is also reduced during the startup phase from the usual 85 Watts to between 35 Watts and 70 Watts, preferably between 40 Watts and 60 Watts.

In a further exemplary embodiment, the lamp is adjusted to a luminous flux of less than 2,000 lm and/or has a power requirement of less than 30 Watts, in particular from 15 Watts to 25 Watts. The aforementioned range of values for the power relates to quasi-stationary operation of the mercury-free halogen metal vapor high-pressure discharge lamp, i.e. after termination of its ignition and startup phase, when the metal halides in the discharge space of the lamp are fully vaporized. During its startup phase, the lamp is preferably operated at a significantly higher power in the range of preferably from 40 to 60 Watts so as to achieve rapid vaporization of the metal halides.

A mercury-free halogen metal vapor high-pressure discharge lamp with a power consumption of 25 Watts during normal operation and with an increased color temperature compared with the prior art is particularly advantageous. The standard mercury-free halogen metal vapor high-pressure discharge lamp for vehicle headlamps (also called a D4 lamp) has a color temperature of 4100 Kelvin. A higher color temperature improves the perception of obstacles in darkness, as well as the visibility. The halogen metal vapor high-pressure discharge lamp according to the particularly preferred exemplary embodiment of the invention therefore has a color temperature in the range from 4500 Kelvin to 5200 Kelvin. In order to achieve such a high color temperature, the metal halides contained in the discharge space of the discharge lamp according to the invention preferably include sodium and scandium, the molar ratio of sodium to scandium preferably lying in the range from 2.0 to 2.8 and particularly preferably at 2.5. In addition, the metal halides contained in the discharge space of the discharge lamp according to the invention also include for the same purpose indium halide with a proportion in the range from 2 to 4 per cent by weight. Furthermore, xenon with a cold fill pressure in the range from 10 to 18 bar is preferably used as ignition gas in order to ensure an immediate emission of white light after ignition of the gas discharge in the high-pressure discharge lamp, an increased color temperature and a broadening of the discharge arc. According to a preferred exemplary embodiment, the metal halides also include zinc halide in order to increase and/or set to a desired value the arc voltage of the high-pressure discharge lamp according to the invention. It is, however, also possible to operate the lamp without zinc halide so as to achieve an improvement in luminous efficiency.

Further advantages and preferred embodiments are defined in the subclaims, the description and the drawings.

BRIEF DESCRIPTION OF DRAWINGS

In the drawings, like reference characters generally refer to the same parts throughout the different views. The drawings are not necessarily to scale, emphasis instead generally being placed upon illustrating the principles of the invention. In the following description, various embodiments of invention are described with reference to the following drawings, in which.

The following detailed description refers to the accompanying drawings that show, by way of illustration, specific details and embodiments in which the invention may be practiced.

Figure 1:
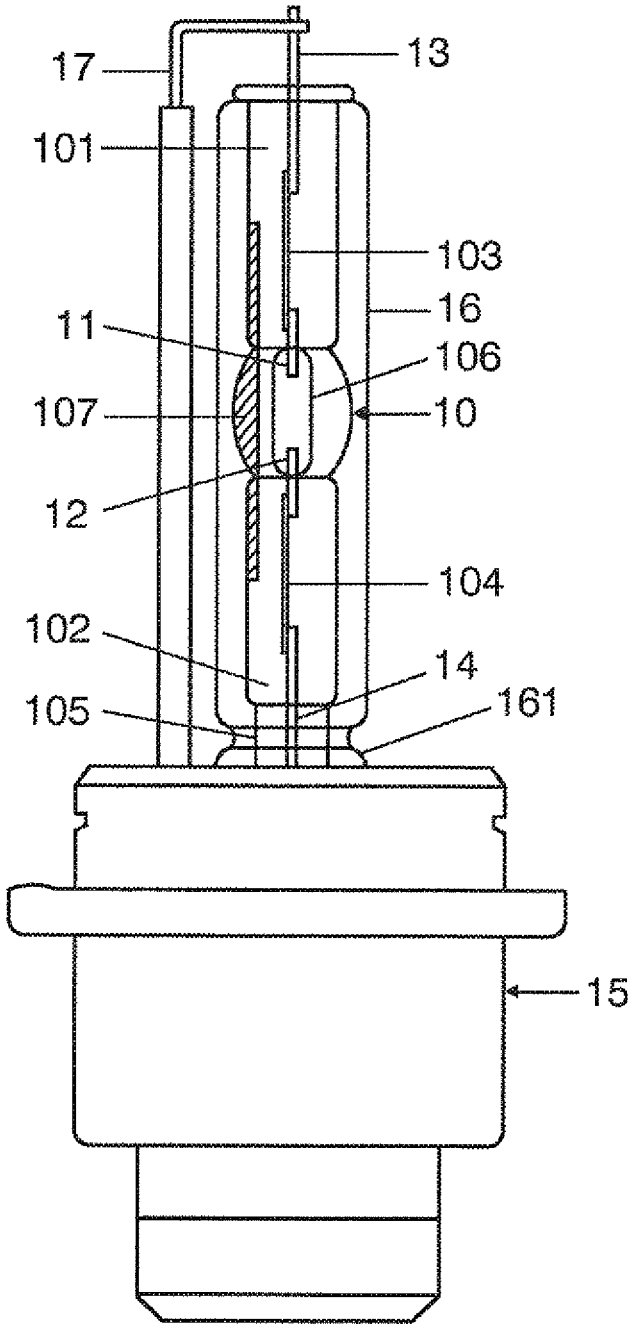
FIG. 1 shows a schematic representation of a longitudinal cross-section through a mercury-free discharge lamp according to the preferred exemplary embodiments of the invention.

FIG. 1 shows a schematic longitudinal cross-section through a mercury-free discharge lamp according to the invention.

This lamp is intended for use in a vehicle headlamp. It has a discharge vessel 10, sealed on both sides and made of quartz glass. The discharge space of the discharge vessel preferably has a volume in the range from 16 $mm^3$ to 34 $mm^3$, in particular 17 $mm^3$ to 22 $mm^3$ being particularly preferred. In the discharge lamp shown here, the discharge space has a volume of 20.0 $mm^3$, in which an ionizable filling is enclosed in a gas-tight manner. In the region of the discharge space 106, the inner contour of the discharge vessel 10 is advantageously fashioned in a circularly cylindrical manner and its outer contour in an ellipsoidal manner.

In order to provide the smaller volume of the discharge space 106, the discharge vessel 10 can be dimensioned such that the internal diameter of the discharge vessel 10 in the region of the discharge space 106 measures between 1.5 mm and 2.7 mm, in particular between 2.1 mm and 2.5 mm. In the exemplary embodiment shown in FIG. 1, the internal diameter of the discharge vessel 10 in the region of the discharge space 106 is 2.4 mm and its external diameter is 6.0 mm.

The two ends 101, 102 of the discharge vessel 10 are each sealed by means of a molybdenum foil seal 103, 104. The molybdenum foils 103, 104 each have a length of approx. 6.5 mm, a width of approx. 2 mm and a thickness of approx. 25 μm.

In the interior of the discharge vessel 10 two electrodes 11, 12 are located between which the discharge arc responsible for the emission of light forms during operation of the lamp. The electrodes 11, 12 are composed of tungsten. Their thickness or their diameter lies in the range from 0.2 mm to 0.3 mm, in particular 0.23 mm to 0.28 mm, the length of the portions of the electrodes extending into the discharge space 106 being 0.3 mm to 1.8 mm. The optical distance between the ends of the electrodes 11, 12 protruding into the discharge space 106 is preferably approximately 3.2 mm to 3.8 mm.

The electrodes 11, 12 are each connected in an electrically conductive manner via one of the molybdenum foil seals 103, 104 and via the socket-remote current feed 13 and the current return 17 or via the current feed 14 at the socket end to an electrical connection of the lamp socket 15 composed of plastic. The overlap between the electrode 11 and the molybdenum foil 103 connected to it may be 1.3 mm±0.15 mm.

The discharge vessel 10 is enclosed by a glass outer bulb 16. The outer bulb 16 has an extension 161 braced in the socket 15. The discharge vessel 10 has at the socket end a tube-like extension 105 made of quartz glass, in which the socket-end current feed 14 runs.

The surface region of the discharge vessel 10 facing the current return 17 may be furnished with a translucent electrically conductive coating 107. This coating 107 preferably extends in a longitudinal direction of the lamp over the entire length of the bulb 106 and over a part, approx. 50 per cent, of the length of the sealed ends 101, 102 of the discharge vessel 10. The coating 107 is preferably applied to the outside of the discharge vessel 10 and extends over approx. 5 per cent to 10 per cent of the extent of the discharge vessel 10. The coating 107 is composed of doped tin oxide, for example of tin oxide doped with fluorine or antimony or for example of tin oxide doped with boron and/or lithium.

This high-pressure discharge lamp is operated in a horizontal position, i.e. with electrodes 11, 12 arranged in a horizontal plane, the lamp being oriented such that the current return 17 runs beneath the discharge vessel 10 and the outer bulb 16. Details of this coating 107, which acts as an ignition aid, are described in EP 1 632 985 A1. The outer bulb 16 is composed of quartz glass which is doped with substances such as cerium oxide and titanium oxide that absorb ultraviolet rays. Suitable glass compositions for the outer-bulb glass are disclosed in EP 0 700 579 B1.

Light-emitting metal halides and buffer metal halides as well as xenon as a starting rare gas are enclosed in a gas-tight manner in the discharge space 106.

The light-emitting metal halides, which primarily fulfill the function of emitting light, may, for example, be a compound of the halides of Na, SC and In. The buffer metal halides serve primarily to increase the arc voltage and to control the color so as to obtain a desired light color (white light). The buffer metal halides may, for example, be a compound of the halides of Al, Cs, Ho, In, Tl, Tm and Zn. The total quantity of metal halides according to the invention is 5 mg/ml to 15 mg/ml. This ensures that the arc which forms between the electrodes has an adequate spatial extension, i.e. an adequate width and an adequate cross-section.

As described hereinabove, the internal diameter of the discharge vessel 10 in the region of the discharge space 106 in the center between the opposing electrodes 11, 12 is approximately 1.5 mm to 2.7 mm. The optical distance between the ends of the electrodes 11, 12 protruding into the discharge space 106 is approximately 3.2 mm to 3.8 mm and the length of the portions of the electrodes 11, 12 extending into the discharge space 106 is approximately 0.3 mm to 1.8 mm. Such a configuration ensures a stable discharge at a low power of approximately 15 Watts to 30 Watts.

In addition, the discharge vessel 10 may have in the region of the discharge space 106 along its longitudinal axis smaller internal dimensions than conventional discharge vessels from the prior art, the distance between the ends of the electrodes 11, 12 on the discharge side being approximately 3.2 mm to 3.8 mm (less than 4.2 mm, as per the ECE specifications). The length of the portions of the electrodes 11, 12 extending into the discharge space is approximately 0.3 mm to 1.8 mm (less than the length of 1.0 mm to 2.0 mm according to the prior art).

Furthermore, the internal diameter of the discharge vessel 10 in the region of the discharge space 106 in the center between the opposing electrodes 11, 12 is approximately 1.5 mm to 2.7 mm (less than the corresponding maximum internal diameter of the discharge space according to the prior art). The discharge space 106 thus has a smaller volume.

Although the arc voltage is reduced, the dissipation of heat from the discharge space 106 is however reduced and the luminous flux and luminous efficiency can be improved. Although the electrical power fed to the discharge lamp is approximately 15 Watts to 30 Watts and thus lower than in lamps according to the prior art which have an electrical power consumption of 35 Watts, the discharge lamp according to the invention achieves substantially the same luminous efficiency as lamps according to the prior art which are operated at 35 Watts.

Furthermore, because the distance between the ends of the electrodes 11, 12 on the discharge side is approximately 3.2 to 3.8 mm (less than the ECE specifications) and the length of the portions of the electrodes 11, 12 extending into the discharge space 106 is approximately 0.3 mm to 1.8 mm (less than the length of 1.0 to 2.0 mm according to the prior art), the light-emitting metal halide moreover cannot condense at the base of the electrodes 11, 12. This likewise improves the luminous efficiency.

The intermediate space between the discharge vessel 10 and the outer bulb 16 is filled with a rare gas having a pressure of approximately 1 bar or less, so the space serves as an insulator against the heat radiated from the discharge space 106.

It has proven particularly advantageous for xenon to be introduced into the intermediate space with a pressure of from 50 mbar to 200 mbar, as particularly good insulation is achieved by this means. However, Ar, $I_2$ and $SF_6$ also have advantageous insulating properties. Instead of introducing a thermally insulating gas into the intermediate space, it may also be advantageous to evacuate the intermediate space, whereby, particularly in the case of a vacuum of less than 0.01 mbar, good insulation can be observed.

Figure 2:
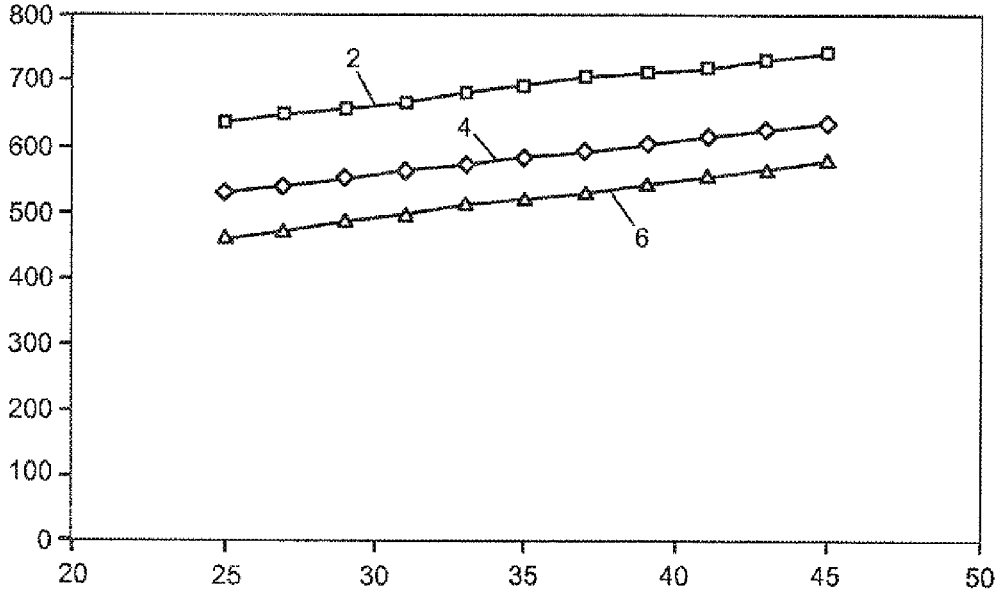
FIG. 2 shows a graphic comparative representation of two lamps with different outer bulb fill gases, the maximum outer bulb temperature in degrees Celsius being plotted on the vertical axis and the electrical power consumption of the lamp in watts being plotted on the horizontal axis.

FIG. 2 shows a mercury-free halogen metal vapor high-pressure discharge lamp (D4 lamp) in which the intermediate space has been filled with various gases or evacuated. The maximum outer-bulb temperature for the different outer-bulb fillings or vacuum has been plotted as a function of the electrical power consumption of the lamp.

Represented on the horizontal axis in FIG. 2 is the applied power in watts, while the vertical axis shows the measured maximum temperature of the outer bulb. A lower temperature of the outer bulb means that a lower thermal conduction of the filling gas is taking place.

In FIG. 2, the graph 2 shows the measured values of a D4 lamp with air in the outer bulb, the graph 4 the measured values with xenon in the outer bulb and the graph 6 the measured values with an evacuated outer bulb.

As can clearly be seen from FIG. 2, the filling with air shows a greater thermal conductivity and thus also a greater outer-bulb temperature than the lamps filled with xenon or a vacuum.

As a result of the lower thermal conductivity of xenon or a vacuum compared to air, less heat is therefore also conducted from the discharge space to the outer bulb, so the discharge space has the temperature needed even at reduced power.

FIG. 1 shows a longitudinal cross-section through a halogen metal vapor high-pressure discharge lamp according to the particularly preferred exemplary embodiments of the invention. According to the particularly preferred exemplary embodiment of the halogen metal vapor high-pressure discharge lamp according to the invention, metal halides contained in the discharge space are halides of the metals sodium, scandium, indium and zinc. Xenon serves as ignition gas and for generating light immediately after ignition of the gas discharge. The total quantity of metal halides in the discharge space 106 is 0.2 mg in this particularly preferred exemplary embodiment. The total quantity of 0.2 mg metal halide contains 38.2 per cent by weight sodium iodide (NaI), 44 per cent by weight scandium iodide ($ScI_3$), 2.8 per cent by weight indium iodide (InI) and 15 per cent by weight zinc iodide ($ZnI_2$). The volume of the discharge space 106 is 0.02 ml or 20 $mm^3$. The discharge space 106 also contains xenon at a cold fill pressure of 12 bar. The diameter or the thickness of the electrodes 11, 12 is 0.275 mm in the particularly preferred exemplary embodiment and the distance or the optically effective distance between the electrodes 11, 12 is 3.6 mm.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

Additionally, please cancel the originally-filed Abstract of the Disclosure, and add the accompanying new Abstract of the Disclosure which appears on a separate sheet in the Appendix.

The invention claimed is:

1. A mercury-free discharge lamp comprising:

a translucent discharge vessel which has a discharge space into which electrodes protrude for generating a gas discharge, said discharge space having a volume in the range from 17 $mm^3$ to 22 $mm^3$;

wherein metal halides and ignition gas are contained in the discharge space, wherein the metal halides are present in a quantity in the range from 5 milligrams to 15 milligrams per 1 milliliter of discharge space volume in the discharge space;

wherein the discharge vessel is enveloped by a translucent outer bulb, wherein an intermediate space between outer bulb and discharge vessel is filled with a gas or gas mixture having a lower thermal conductivity than air and having a pressure less than 1 bar;

wherein the mercury-free discharge lamp has a luminous flux less than 2000 lm; and wherein, after termination of its ignition and startup phase, the electrical power of the mercury-free discharge lamp is less than 30 Watts.

2. The discharge lamp as claimed in claim 1, wherein the metal halides comprise halides of the metals sodium, scandium and indium.

3. The discharge lamp as claimed in claim 2, wherein the metal halides additionally comprise zinc halide.

4. The discharge lamp as claimed in claim 2, wherein the molar ratio of sodium to scandium lies in the range of values from 2.0 to 2.8.

5. The discharge lamp as claimed in claim 2, wherein the proportion of the metal halides made up by indium halide lies in the range from 2 percent by weight to 4 per cent by weight.

6. The discharge lamp as claimed in claim 1, wherein the ignition gas comprises xenon having a cold fill pressure in the range from 10 bar to 18 bar.

7. The discharge lamp as claimed in claim 1, wherein the lamp has an electrical power consumption during its startup phase in the range from 35 Watts to 70 Watts.

8. The discharge lamp as claimed in claim 1, wherein the lamp has an electrical power consumption during its operation after termination of the ignition and startup phase in the range from 20 Watts to 25 Watts.

9. The discharge lamp as claimed in claim 1, wherein the intermediate space between outer bulb and discharge vessel is filled with xenon or argon, or a vacuum having a pressure of less than 1 mbar, is present in the intermediate space.

10. The discharge lamp as claimed in claim 1, wherein in the intermediate space between outer bulb and discharge vessel a vacuum having a pressure of less 0.01 mbar is present in the intermediate space.

* * * * *

UNITED STATES PATENT AND TRADEMARK OFFICE

CERTIFICATE OF CORRECTION

PATENT NO. : 8,736,165 B2
APPLICATION NO. : 13/129581
DATED : May 27, 2014
INVENTOR(S) : Florian Bedynek et al.

It is certified that error appears in the above-identified patent and that said Letters Patent is hereby corrected as shown below:

On the Title Page, Item (73), Assignee, delete "Gesellschaft MIT Beschraenkter" and write "Gesellschaft mit beschraenkter" in place thereof.

In the Specification

Column 4, line 10, delete "of invention" and write "of the invention" in place thereof.

Column 4, between lines 20 and 21, add "DETAILED DESCRIPTION".

Column 7, lines 22 to 25, delete the entire paragraph.

Signed and Sealed this
Tenth Day of February, 2015

Michelle K. Lee

Michelle K. Lee
*Deputy Director of the United States Patent and Trademark Office*